US006235454B1

(12) United States Patent
Burberry et al.

(10) Patent No.: US 6,235,454 B1
(45) Date of Patent: May 22, 2001

(54) PROCESS FOR FORMING AN ABLATION IMAGE

(75) Inventors: Mitchell Burberry; Lee W. Tutt, both of Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/515,149

(22) Filed: Feb. 29, 2000

(51) Int. Cl.[7] ..... G03C 5/00
(52) U.S. Cl. ..... 430/346; 430/292; 430/945
(58) Field of Search ..... 430/201, 292, 430/945, 346, 363

(56) References Cited

U.S. PATENT DOCUMENTS

| | | | | |
|---|---|---|---|---|
| 5,171,650 | | 12/1992 | Ellis et al. . | |
| 5,400,147 | * | 3/1995 | Korn et al. | 358/297 |
| 5,468,591 | | 11/1995 | Pearce et al. . | |
| 5,503,956 | * | 4/1996 | Kaszczuk et al. | 430/200 |
| 5,742,401 | * | 4/1998 | Bringley et al. | 358/297 |

* cited by examiner

*Primary Examiner*—John A. McPherson
(74) *Attorney, Agent, or Firm*—Harold E. Cole

(57) ABSTRACT

A process of forming a single color, ablation image having a D-max, or unexposed area, D-min and D-intermediate, comprising imagewise-heating, by means of a laser in the absence of a separate receiving element, an ablative recording element comprising a support having thereon, in order, a barrier layer having UV density and a colorant layer comprising a colorant dispersed in a polymeric binder, the colorant layer having an infrared-absorbing material associated therewith, the laser exposure taking place through the colorant side of the element, a) the laser exposure used to obtain the D-intermediate density is such that the colorant layer in that area is substantially removed but substantially none of the barrier layer in that area is removed, so that the characteristic density vs. decreasing exposure curve of the ablative recording element has a plateau at the D-intermediate density, and b) the laser exposure used to obtain the D-min density is such that both the colorant layer and the barrier in that area are substantially removed.

11 Claims, 1 Drawing Sheet

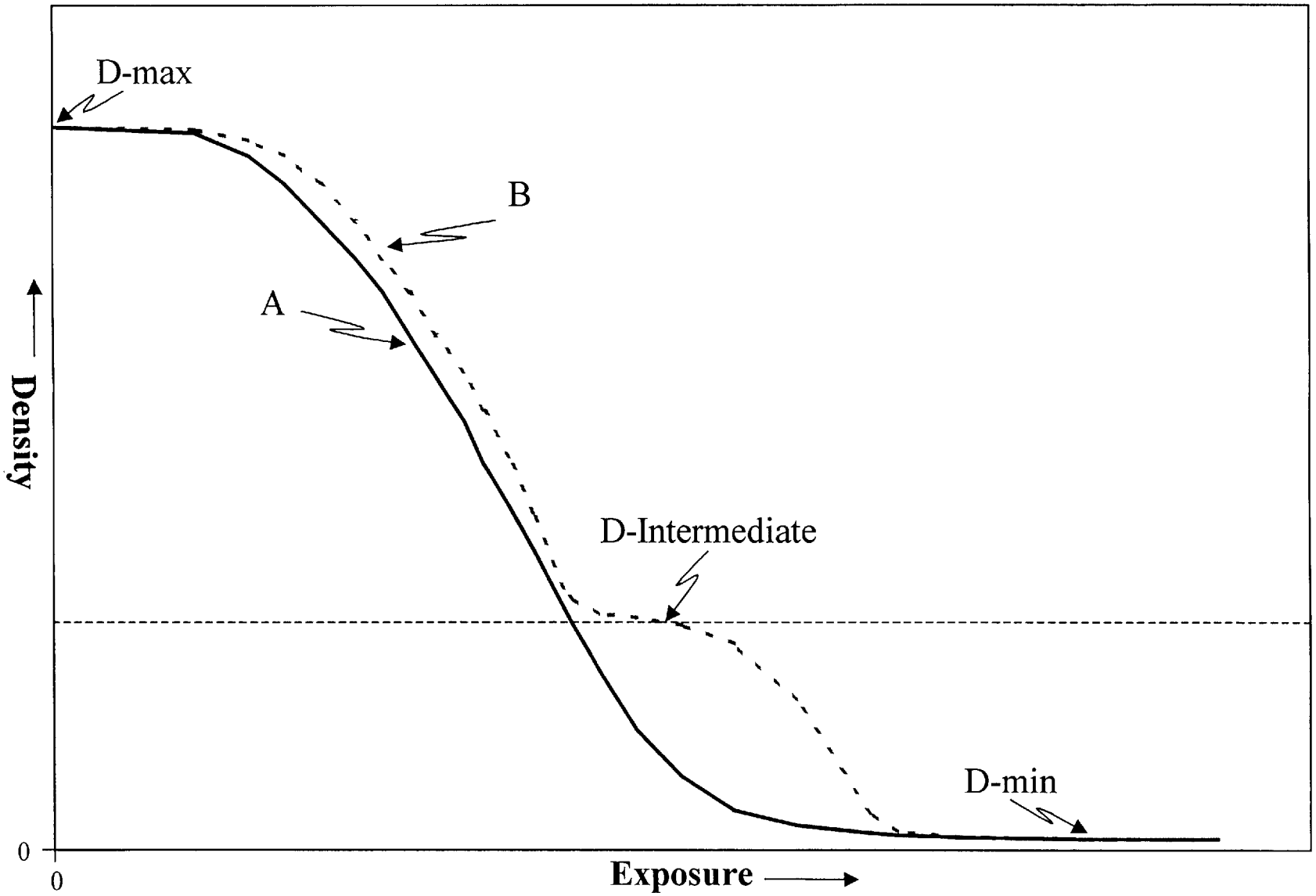
D-max
B
A
D-Intermediate
D-min
Density
Exposure
0
0

PROCESS FOR FORMING AN ABLATION IMAGE

CROSS REFERENCE TO RELATED APPLICATION

Reference is made to commonly-assigned, copending U.S. patent application Ser. No. 09/515,146, filed of even date herewith, (Docket 80458HEC) entitled "Process for Forming an Ablation Image", by Burberry, the disclosure of which is hereby incorporated by reference.

FIELD OF THE INVENTION

This invention relates to a process of forming an ablation image using a barrier layer in a laser ablative recording element.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In one ablative mode of imaging by the action of a laser beam, an element with a dye layer composition comprising an image dye, an infrared-absorbing material, and a binder coated onto a substrate is imaged from the dye side. The energy provided by the laser drives off substantially all of the image dye and binder at the spot where the laser beam hits the element. In ablative imaging, the laser radiation causes rapid local changes in the imaging layer thereby causing the material to be ejected from the layer. The transmission density serves as a measure of the completeness of image dye removal by the laser.

Flexographic plates, particularly those using liquid photopolymers, have a problem achieving proper highlights and shadows simultaneously with a single exposure. One method to enhance image quality for flexographic printing applications uses a tinted film process or digital masking. This method involves partially ablating a dry ablation film such as the Kodak Direct Image Recording Film to obtain a mask. This mask is used to generate a flexographic plate.

This partial ablation method uses three levels of UV transmission: unimaged (D-max), partially ablated (D-intermediate) and fully imaged (D-min) to generate a three-level mask. By controlling the three levels of UV transmission, the highlights, midtones and shadows of the flexographic plate can be adjusted independently for optimum reproduction with a single UV exposure.

Ablation films, such as the Kodak Direct Image Recording Film, are generally designed to have very high contrast. There is a problem, however, using this ablation film in the partial ablation method when trying to maintain a uniform density level at the partially ablated (D-intermediate) level. The partially ablated (D-intermediate) density varies rapidly with fluctuations in laser power, spot size, spot shape, and focus. The slope of the curve of density vs. exposure is a good measure of the film's susceptibility to these fluctuations.

U.S. Pat. No. 5,468,591 relates to a barrier layer, such as a vinyl polymer and an IR-dye, for laser ablative imaging. There is a problem using that recording element in the partial ablation method because its characteristic density vs. exposure curve does not exhibit a plateau or low slope region at intermediate exposures, so that the intermediate density level is susceptible to fluctuations in exposure.

U.S. Pat. No. 5,171,650 relates to an ablation-transfer image recording process. In that process, an element is employed which contains a dynamic release layer which absorbs imaging radiation which in turn is overcoated with an ablative carrier topcoat. Examples of the dynamic release layer include thin films of metals. An image is transferred to a receiver in contiguous registration therewith. However, this process requires the element to be exposed through the support so that there is no intermediate level of transfer possible.

It is an object of this invention to provide a method of using an ablative recording element that has a characteristic density vs. exposure curve that exhibits a plateau or low slope region at intermediate exposures, so that variations in exposure do not substantially change the partially ablated optical density level. It is another object of this invention to provide a method of using an ablative recording element that has a characteristic density vs. exposure curve that exhibits a plateau or low slope region at intermediate exposures which does not substantially decrease the speed of the recording element.

SUMMARY OF THE INVENTION

These and other objects are achieved in accordance with the invention which comprises a process of forming a single color, ablation image having a D-max, or unexposed area, D-min and D-intermediate, comprising imagewise-heating, by means of a laser in the absence of a separate receiving element, an ablative recording element comprising a support having thereon, in order, a barrier layer having UV density and a colorant layer comprising a colorant dispersed in a polymeric binder, the colorant layer having an infrared-absorbing material associated therewith, the laser exposure taking place through the colorant side of the element, a) the laser exposure used to obtain the D-intermediate density is such that the colorant layer in that area is substantially removed but substantially none of the barrier layer in that area is removed, so that the characteristic density vs. decreasing exposure curve of the ablative recording element has a plateau or local minimum at the D-intermediate density, and b) the laser exposure used to obtain the D-min density is such that both the colorant layer and the barrier in that area are substantially removed.

By use of the invention, the density obtained at an intermediate level is relatively insensitive to variations, resulting in better image quality for multi-density printing applications.

BRIEF DESCRIPTION OF DRAWING

FIG. 1 illustrates a comparison between two characteristic curves of density vs. exposure. Curve A represents the characteristic curve of a typical ablative recording element. The density increases smoothly as the exposure decreases from D-min to D-max. There is no plateau or local minimum in the slope between these two end points. Curve B represents the characteristic curve of an ablative recording element used in the process of the invention. At an intermediate density of Curve B, the rate of increase with decreasing exposure goes through a plateau or local minimum.

DETAILED DESCRIPTION OF THE INVENTION

In a preferred embodiment of the invention, the barrier layer used in the process of the invention comprises a metal such as a transition metal or a group III, group IV or group V metal. In another preferred embodiment, the metal is titanium, nickel or iron.

While any coverage of the thin metal barrier layer may be employed which is effective for the intended purpose, good results have been obtained at a thickness of from about 500 Å to about 5,000 Å.

The ablation elements used in the process of the invention can be used to obtain medical images, reprographic masks, printing masks, etc. The image obtained can be a positive or a negative image.

The invention is especially useful in making reprographic masks which are used in flexographic printing applications. The masks are placed over a photosensitive material, such as a printing plate, and exposed to a light source. The photosensitive material usually is activated only by certain wavelengths. For example, the photosensitive material can be a polymer which is crosslinked or hardened upon exposure to ultraviolet or blue light but is not affected by red or green light. For these photosensitive materials, the mask, which is used to block light during exposure, must absorb all wavelengths which activate the photosensitive material in the D-max regions and absorb little in the D-min regions. For printing plates, it is therefore important that the mask have high UV D-max. If it does not do this, the printing plate would not be developable to give regions which take up ink and regions which do not.

The dye removal process can be by either continuous (photographic-like) or halftone imaging methods.

The higher efficiency achieved in accordance with the invention greatly expands the UV contrast of these ablative elements, which enhances their usefulness when exposing UV-sensitive printing plates with UV radiation.

Any polymeric material may be used as the binder in the recording element employed in the process of the invention. For example, there may be used cellulosic derivatives, e.g., cellulose nitrate, cellulose acetate hydrogen phthalate, cellulose acetate, cellulose acetate propionate, cellulose acetate butyrate, cellulose triacetate, a hydroxypropyl cellulose ether, an ethyl cellulose ether, etc., polycarbonates; polyurethanes; polyesters; poly(vinyl acetate); poly(vinyl halides) such as poly(vinyl chloride) and poly(vinyl chloride) copolymers; poly(vinyl ethers); maleic anhydride copolymers; polystyrene; poly(styrene-co-acrylonitrile); a polysulfone; a poly(phenylene oxide); a poly(ethylene oxide); a poly(vinyl alcohol-co-acetal) such as poly(vinyl acetal), poly(vinyl alcohol-co-butyral) or poly(vinyl benzal); or mixtures or copolymers thereof. The binder may be used at a coverage of from about 0.1 to about 5 $g/m^2$.

In a preferred embodiment, the polymeric binder used in the recording element employed in process of the invention has a polystyrene equivalent molecular weight of at least 100,000 as measured by size exclusion chromatography, as described in U.S. Pat. No. 5,330,876.

The colorant layer of the invention may also contain a hardener to crosslink the polymeric binder or react with itself to form a interpenetrating network. Examples of hardeners that can be employed in the invention fall into several different classes such as the following (including mixtures thereof):

a) formaldehyde and compounds that contain two or more aldehyde functional groups such as the homologous series of dialdehydes ranging from glyoxal to adipaldehyde including succinaldehyde and glutaraldehyde; diglycolaldehyde; aromatic dialdehydes, etc.;

b) blocked hardeners (substances usually derived from the active hardener that release the active compound under appropriate conditions) such as substances that contain blocked aldehyde functional groups, such as tetrahydro-4-hydroxy-5-methyl-2(1H)-pyrimidinone polymers, polymers of the type having a glyoxal polyol reaction product consisting of 1 anhydroglucose unit: 2 glyoxal units, dimethoxylethanal-melamine non-formaldehyde resins, 2,3-dihydroxy-1,4-dioxane, blocked dialdehydes and N-methylol compounds obtained from the condensation of formaldehyde with various aliphatic or cyclic amides, ureas, and nitrogen heterocycles;

c) active olefinic compounds having two or more olefinic bonds, especially unsubstituted vinyl groups, activated by adjacent electron withdrawing groups, such as divinyl ketone; resorcinol bis(vinylsulfonate); 4,6-bis(vinylsulfonyl)-m-xylene; bis(vinylsulfonylalkyl) ethers and amines; 1,3,5-tris(vinylsulfonyl) hexahydro-s-triazine; diacrylamide; 1,3 -bis(acryloyl)urea;

N,N'-bismaleimides; bisisomaleimides; bis(2-acetoxyethyl) ketone; 1,3,5-triacryloylhexahydro-s-triazine; and blocked active olefins of the type bis(2-acetoxyethyl) ketone and 3,8-dioxodecane-1,10-bis(pyridinium perchlorate) bis(vinyl sulfonylmethane), bis(vinyl sulfonylmethyl ether), and the like;

d) compounds that contain two or more amino groups such as ethylene diamine; and e) inorganic salts such as aluminum sulfate; potassium and ammonium alums of aluminum; ammonium zirconium carbonate; chromium salts such as chromium sulfate and chromium alum; and salts of titanium dioxide, zirconium dioxide, etc.

In a preferred embodiment, the hardener is a diisocyanate, such as a homopolymer of 1,6-hexamethylene diisocyanate, N-(4-((2-hydroxy-5-methylphenyl)azo)-1-naphthyl)azo)-1H-perimidine). The hardener may be used in any amount effective for the intended purpose. In general, it may be used from about 0.1% to about 25% by weight of the polymeric binder.

To obtain a laser-induced, ablative image using the process of the invention, a diode laser is preferably employed since it offers substantial advantages in terms of its small size, low cost, stability, reliability, ruggedness, and ease of modulation. In practice, before any laser can be used to heat a ablative recording element, the element must contain an infrared-absorbing material, such as pigments like carbon black, or cyanine infrared-absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the colorant layer and converted to heat by a molecular process known as internal conversion. Thus, the construction of a useful colorant layer will depend not only on the hue, transferability and intensity of the colorant, but also on the ability of the colorant layer to absorb the radiation and convert it to heat. The infrared-absorbing material or dye may be contained in the colorant layer itself or in a separate layer associated therewith, i.e., above or below the colorant layer. As noted above, the laser exposure in the process of the invention takes place through the colorant side of the ablative recording element, which enables this process to be a single-sheet process, i.e., a separate receiving element is not required.

Lasers which can be used in the invention are available commercially. There can be employed, for example, Laser Model SDL-2420-H2 from Spectra Diode Labs, or Laser Model SLD 304 V/W from Sony Corp.

Any dye can be used in the ablative recording element employed in the invention provided it can be ablated by the action of the laser. Especially good results have been obtained with dyes such as anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown Mg and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.);

(magenta)

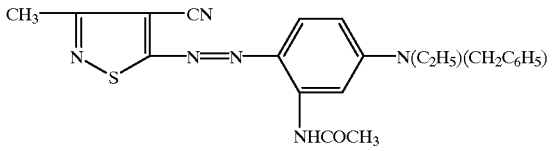

-continued (magenta)

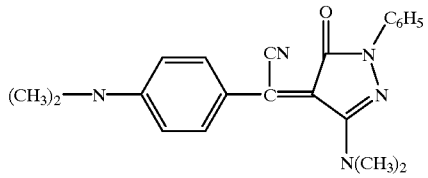

(yellow)

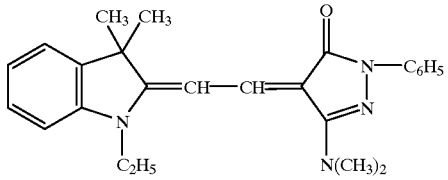

(yellow)

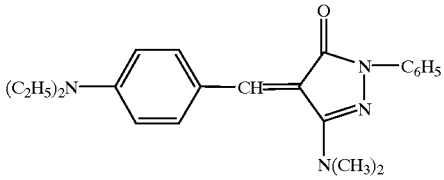

(cyan)

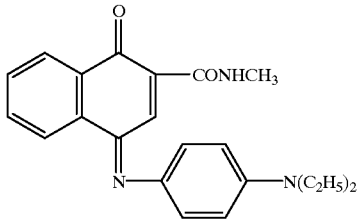

(cyan)

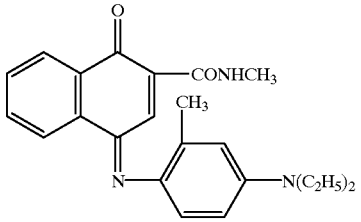

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

Pigments which may be used in the colorant layer of the ablative recording layer of the invention include carbon black, graphite, metal phthalocyanines, etc. When a pigment is used in the colorant layer, it may also function as the infrared-absorbing material, so that a separate infrared-absorbing material does not have to be used.

The colorant layer of the ablative recording element employed in the invention may be coated on the support or printed thereon by a printing technique such as a gravure process.

Any material can be used as the support for the ablative recording element employed in the invention provided it is dimensionally stable and can withstand the heat of the laser. Such materials include polyesters such as poly(ethylene naphthalate); poly(ethylene terephthalate); polyamides;

polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 $\mu$m. In a preferred embodiment, the support is transparent.

The following example is provided to illustrate the invention.

EXAMPLE

The following dyes were used in this Example:

UV Dye

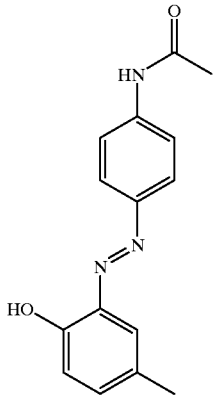

Yellow Dye

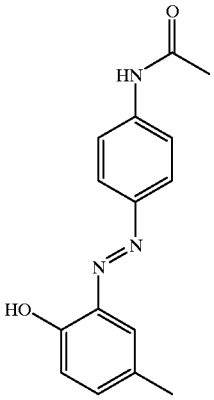

Cyan Dye

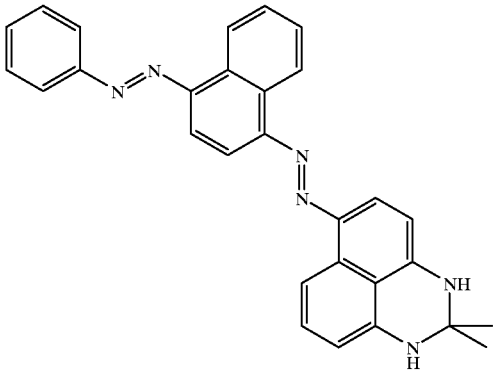

-continued

IR Dye-1

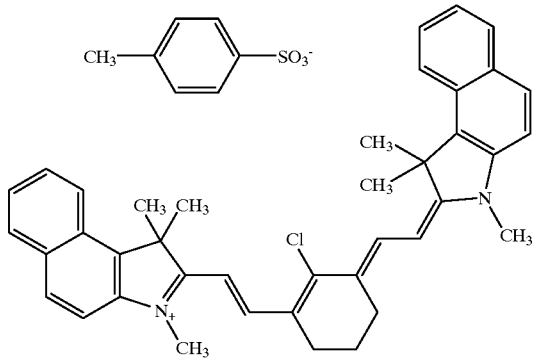

Control Element 1 (Polycyanoacrylate barrier layer)

A 100 $\mu$m poly(ethylene terephthalate) support was coated with a barrier layer containing the following ingredients at the indicated aim dry overages: 0.38 g/m$^2$ poly(methyl 2-cyanoacrylate), 0.05 g/m$^2$IR Dye-1, and 0.003 g/m$^2$ surfactant FC-431® (3M Corp.) from acetonitrile.

On top of the barrier layer was coated an image layer from a methyl isobutyl ketone/ethanol 8:2 solvent mixture at a wet laydown of 32 cc/m$^2$ containing the following dissolved ingredients at the indicated aim dry coverages:

- 0.60 g/m$^2$ Cellulose nitrate (1000–15000 cps) (Aqualon Co.)
- 0.28 g/m$^2$ UV Dye
- 0.13 g/m$^2$ Yellow Dye
- 0.16 g/m$^2$ Cyan Dye
- 0.22 g/m$^2$ IR Dye-1

Elements 1–6 of the Invention (Metal barrier layer)

These elements were prepared the same as Control 1 except that the barrier layer was various metals as shown in Table 1 which were deposited by vacuum deposition. Prior to vacuum deposition, the substrate was coated with a subbing layer of poly(acrylonitrile-co-vinylidene chloride-co-acrylic acid) (14:79:7 wt. ratio (0.05 g/m$^2$).

The amount of metal barrier layer was measured by UV optical density as reported in Table 1.

The elements were then coated with the same image layer as in Control 1. The image layer was adjusted to make the total UV (image layer plus barrier layer) density fall approximately in the range between 3.5 and about 4.2.

Imaging

The above recording elements were imaged with a diode laser imaging device as described in U.S. Pat. No. 5,387,496. The laser beam had a wavelength of 830 nm and a nominal power output of 450 mWatts per channel at the end of the optical fiber. The Table lists UV transmission density recorded on an X-Rite® densitometer Model 310 (X-Rite Co.).

The intermediate UV density or plateau, and the exposure required to reach the plateau are reported. Where some recording elements exhibit more than one plateau, only the one associated with the undisturbed metal barrier layer is reported. The speed of the recording elements, as measured by the exposure needed to reach D-min, were acceptable for the purpose of this comparison and fell in the range between 410 and 585 mJ/cm$^2$.

TABLE

| Element | Metal | Total UV Density | Barrier UV Density | Density at Plateau (o.d) | Exposure* at Plateau (mJ/cm$^2$) |
|---|---|---|---|---|---|
| 1 | Fe | 3.62 | 1.6 | 1.6 | 260 |
| 2 | Fe | 4.25 | 2.3 | 2.1 | 260 |
| 3 | Ti | 4.40 | 2.5 | 2.2 | 250 |
| 4 | Ti | 4.21 | 1.2 | 1.4 | 350 |
| 5 | Ti | 3.69 | 0.2 | 0.4 | 350 |
| 6 | Ni | 4.58 | 1.5 | 1.8 | 375 |
| Control 1 | ** | 3.85 | none | *** | *** |

*Exposure needed to acheive plateau density
**Barrier layer was polycyanoacrylate and IR-dye
***No plateau.

The above results show that the control element exhibited no plateau region. All the elements of the invention, however, had at least one plateau and would thus be less susceptible to fluctuations in exposure conditions in the plateau region.

The invention has been described in detail with particular reference to preferred embodiments thereof, but it will be understood that variations and modifications can be effected within the spirit and scope of the invention.

What is claimed is:

1. A process of forming a single color, ablation image having a D-max, or unexposed area, D-min and D-intermediate, comprising imagewise-heating, by means of a laser in the absence of a separate receiving element, an ablative recording element comprising a support having thereon, in order, a barrier layer having UV density and a single colorant layer comprising a colorant dispersed in a polymeric binder and having an infrared-absorbing material, said laser exposure taking place through the colorant side of said element, a) said laser exposure used to obtain said D-intennediate density is such that said colorant layer in that area is substantially removed but substantially none of said barrier layer in that area is removed, so that the characteristic density vs. decreasing exposure curve of said ablative recording element has a plateau at said D-intermediate density, and b) said laser exposure used to obtain said D-min density is such that both said colorant layer and said barrier in that area are substantially removed.

2. The process of claim 1 wherein said barrier layer comprises a thin metal.

3. The process of claim 2 wherein said metal is a transition metal or a group III, group IV or group V metal.

4. The process of claim 2 wherein said metal is titanium, nickel or iron.

5. The process of claim 1 wherein said infrared-absorbing material is a dye.

6. The process of claim 1 wherein said support is transparent.

7. The process of claim 1 wherein said colorant is a dye.

8. The process of claim 1 wherein said colorant is a pigment.

9. The process of claim 1 wherein said polymeric binder comprises cellulose nitrate.

10. The process of claim 1 wherein said colorant layer contains a hardener.

11. The process of claim 10 wherein said hardener is a diisocyanate.

* * * * *